United States Patent [19]

Adamski

Best Available Copy

[11] 4,296,327

[45] Oct. 20, 1981

[54] MULTI-STAGE COLLECTIVE FIELD CHARGED PARTICLE ACCELERATOR

[75] Inventor: John L. Adamski, Bothell, Wash.

[73] Assignee: The Boeing Company, Seattle, Wash.

[21] Appl. No.: 155,461

[22] Filed: Jun. 2, 1980

[51] Int. Cl.[3] ..... H01J 27/00

[52] U.S. Cl. ..... 250/423 R; 313/359.1

[58] Field of Search ..... 250/423, 427, 396; 313/359, 360

[56] References Cited

U.S. PATENT DOCUMENTS

| | | | |
|---|---|---|---|
| 3,212,974 | 10/1965 | LeBout et al. | 250/423 |
| 4,126,806 | 11/1978 | Kapetanakoes et al. | 250/423 |
| 4,128,764 | 12/1978 | Luce | 250/423 |

OTHER PUBLICATIONS

"Observation of Energetic Ions from a Beam-Generated Plasma", Graybill et al., *Journal of App. Phy.*, vol. 41, No. 1, pp. 236–240, Jan. '70.

*Primary Examiner*—Bruce C. Anderson

*Attorney, Agent, or Firm*—Cole, Jensen & Puntigam

[57] ABSTRACT

The accelerator includes a source of an ensemble or bunch of ions and a plurality of relatavistic electron beam stages, each of which generate a high current electron beam which in turn are injected along the accelerator centerline in a timed sequence to accelerate the ion bunch to increasingly high kinetic energy levels. In each relatavistic electron beam stage, a region of high electric charge is created by the discharge of a high current, short duration pulse between a cathode and anode. The electron beam created by the discharge stops a short distance beyond the anode, due to the buildup of its electric charge, thereby creating a region of high charge which accelerates the ion bunch. Each successive relatavistic electron beam stage is timed to fire when the ion bunch arrives at the region of high charge of that stage, and in operation, increases the kinetic energy of the ion bunch by a factor equal to or greater than the kinetic energy of the electron beam.

10 Claims, 2 Drawing Figures

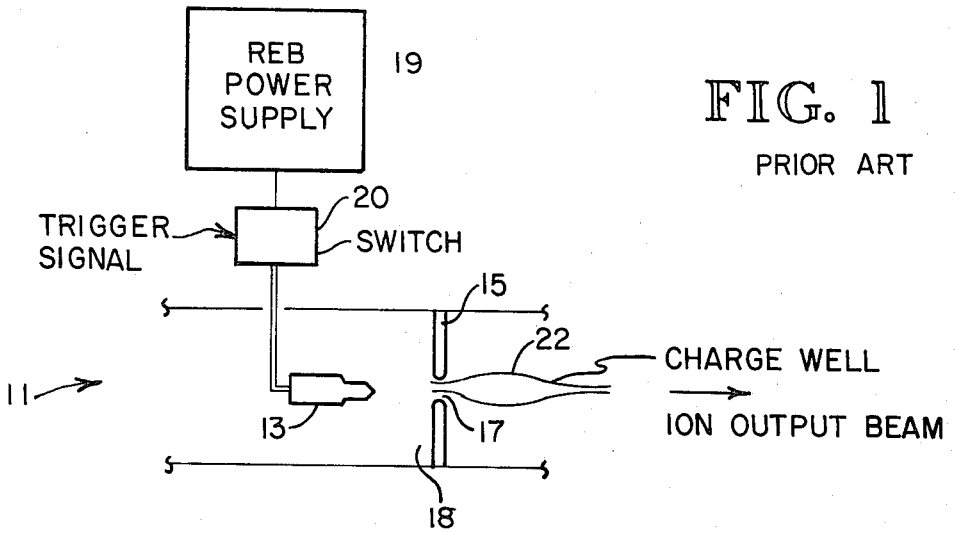
FIG. 1
PRIOR ART
FIG. 2
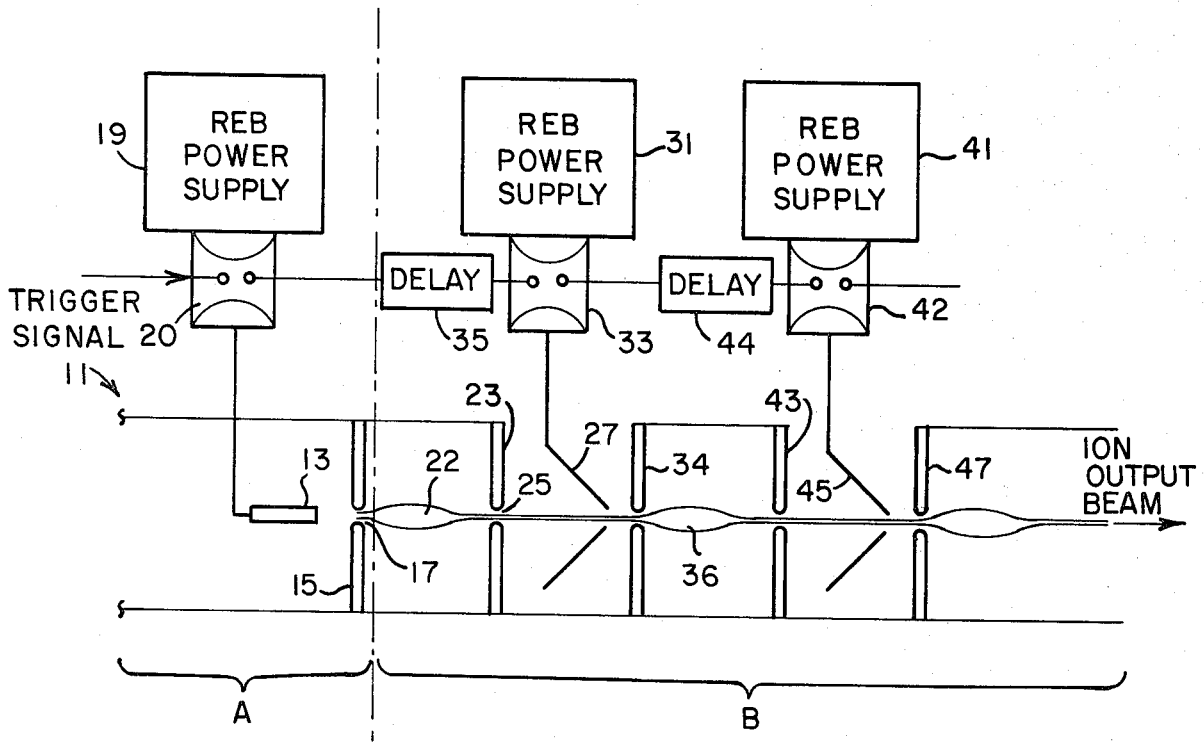

MULTI-STAGE COLLECTIVE FIELD CHARGED PARTICLE ACCELERATOR

BACKGROUND OF THE INVENTION

This invention relates to the art of collective field charged particle accelerators.

In many fields, including thermonuclear fusion technology and basic particle physics research, there is an acknowledged need for a particle accelerator which is capable of producing an extremely high current, high energy particle beam.

The collective field particle accelerator is one known type of accelerator which does in fact produce a particle beam having a fairly high energy level, although for the applications noted above, the energy levels achieved with conventional collective field accelerators are still not high enough. Numerous suggestions have been made as to how conventional collective field accelerators could be modified to substantially increase their energy levels. Electrostatic lenses and traveling wave structures, which in operation would interact with the ion bunch to increase the acceleration of the ions, are among the concepts which have been suggested, although not actually constructed and tested as of yet. However, the increase in ion energy produced by such devices appears to be rather limited. Other suggested techniques are very speculative and unproven.

Accordingly, it is a general object of the present invention to provide an improved collective field charged particle accelerator which overcomes one or more of the disadvantages of the prior art noted above.

It is another object of the present invention to provide such an accelerator which produces an ion beam having a substantially higher energy level than is achievable with conventional collective field accelerators.

It is a further object of the present invention to provide such an accelerator in which the energy level of the output beam can be substantially increased in successive increments.

It is an additional object of the present invention to provide such an accelerator which makes use of conventional collective accelerator apparatus.

SUMMARY OF THE INVENTION

Accordingly, the present invention is a multi-stage collective field charged particle accelerator which comprises (1) means forming a charged particle accelerator chamber, (2) a source of high energy charged particles, such as proton ions, the source of particles producing in operation a particle plasma, (3) a first electron beam means which produces an electron beam which is used to accelerate a portion of the ion plasma, referred to as an ion bunch, by means of its electric field, and (4) at least one additional similar electron beam means, which is fired at specified times relative to the operation of the first electron beam means and the movement of the ion bunch to further accelerate the ion bunch. Each electron beam means includes a cathode source of electrons, power supply means for energizing the cathode, and an anode, which has an opening therethrough, to which the electrons emitted from the cathode are discharged. The electron beam so produced is characterized by a high current, sufficiently great to exceed the space charge limiting current, so that the electron beam stops downstream of the anode, thereby creating a space charge region which greatly accelerates the ion bunch. Each electron beam stage produces a corresponding significant increase in the kinetic energy of the ion bunch.

DESCRIPTION OF THE DRAWINGS

A more thorough understanding of the invention may be obtained by a study of the following detailed description taken in connection with the accompanying drawings in which:

FIG. 1 is a simplified block diagram of the prior art collective field charged particle accelerator.

FIG. 2 is a simplified block diagram of one embodiment of the collective field charged particle accelerator of the present invention.

DESCRIPTION OF THE PREFERRED EMBODIMENT

The present invention is an improvement in collective field charged particle accelerators, which are a class of high energy, high current particle accelerators. FIG. 1 shows in simplified form a conventional collective field accelerator. In operation of the collective field accelerator, shown generally at 11, a cathode 13, initially energized by a high voltage source (not shown), produces a stream of electrons along the centerline of the accelerator, which bombard anode 15, resulting in the release of a large number of ions, referred to as an ion plasma, from anode 15. The cathode and anode 15 are located in a vacuum in an accelerator chamber 18 approximately 12 inches in diameter. Although cathode 13 is shown as a conventional axial cathode, it could also, in another embodiment, be an off-axis cathode. Anode 15 has a central circular opening 17, and is typically made of metal, such as stainless steel, except for the operative region around opening 17 which is a plastic hydrogen-containing material, which, upon bombardment, releases hydrogen protons. Hence, the ion plasma in FIG. 1 comprises protons. The process by which the ion plasma is generated through bombardment of an anode is known as flash-over discharge, as the ion plasma created will substantially cover the central opening 17 in the anode.

An ion bunch from the plasma created by the electron bombardment of anode 15 is then accelerated downstream of the anode 15 by means of a high energy, high current electron beam typically on the order of 3 megavolts. Thus, in a collective field accelerator, the ions are accelerated by a field created by an electron beam, rather than a field created between two plates. The electron beam in a collective field accelerator is known as a relatavistic electron beam, characterized by electron particles having a kinetic energy far greater than their rest mass energy. The relatavistic electron beam is produced by a relativistic beam (REB) power supply 19, which is essentially a pulsed power supply having a very short pulse duration and a very high current. A trigger signal energizes a switch 20, which controls the application of power from the REB power supply 19 to cathode 13.

When a pulse signal is applied to cathode 13, it discharges to anode 15. The electron beam is focused by the opening 17, flowing through it and then proceeding downstream of the anode. The density variation of the beam is such that a very high electric field develops in a region shown as space charge well 22, which is located approximately 0.05–0.5 inches downstream of anode 15. The space charge well is created because the electron beam current is so high that it exceeds the space charge limiting current, so that the electron beam in fact stops downstream of the anode, due to the very high electric charge. The electric field in the vicinity of the charge well rises very steeply, like a spike, and in operation, the electric field oscillates back and forth along the axis of the accelerator. This oscillating region of high space charge has the effect of a virtual cathode, accelerating an ion bunch from the ion plasma to very high energy levels, typically several times that of the kinetic energy of the electron beam itself, i.e. on the order of 6–10 megavolts.

The detailed operation and theory of collective field particle accelerators, briefly explained above, is well known, and is treated extensively in the following references: An article by S. E. Graybill and J. R. Uglum in Vol. 41 Journal of Applied Physics, pp. 236–240, (1970); and a book entitled "Collective Ion Acceleration", by C. L. Olson and Schumacher, published by Springer Verlag (1979).

The present invention, which is shown in simplified schematic form in FIG. 2, uses the elements of the prior art shown in FIG. 1, i.e. an ion plasma created by a relativistic electron beam apparatus. This is shown as region A in FIG. 2. In region B are additional elements which comprise successive relatavistic electron beam particle acceleration stages which supply successive significant increases in particle energy to the ion bunch created in the first stage of the device. Each additional stage includes an REB power supply and a cathode and anode, similar in configuration and arrangement to corresponding apparatus in the first stage of the accelerator, and a grounded plate, positioned slightly forward of the cathode of each additional stage.

FIG. 2 shows a three-stage collective field accelerator, which thus has two stages of acceleration in addition to the conventional first stage. However, it should be understood that the principles of the present invention are not limited to a three-stage device; FIG. 2 is intended to be illustrative of the general concept of using two or more REB stages, fired in a particular time sequence to provide significant increases in particle energy over that achieved by conventional collective field accelerators.

Referring still to FIG. 2, it can be seen that the portion of the apparatus of FIG. 2 to the left of the dashed line, designated as region A, is substantially identical to the structure shown in FIG. 1, and similar numerals are hence used. Positioned downstream of diode 15 and space charge well 22 is a grounded plate 23. Grounded plate 23 has a central opening 25 along the centerline of the accelerator, which is coincident axially with the opening 17 in anode 15. In the embodiment shown, both the opening 17 and the opening 25 are circular, approximately 1 centimeter in diameter. Although the size of the opening is generally significant from an operations standpoint, it will vary somewhat depending on the electron beam; i.e. apparatus is tuned by varying the size of the opening until optimum performance is realized. The configuration of the opening may also be varied.

Grounded plate 23 is typically located approximately between 3 and 30 inches from anode 15 and is comprised of electrically conducting material. In operation of the accelerator, a potential difference is formed between plate 23 and the REB cathode 27 of the second REB stage, which is an off-axis cathode, so that any electrons from the electron beam created by the first REB stage and carried along by the accelerating ion bunch are attracted to plate 23, and hence, electrostatically separated from the ion bunch beam. Further, the potential difference between plate 23 and cathode 27 further accelerates the ion bunch into the cathode/anode region of stage 2 of the accelerator.

The second REB stage thus includes an REB power supply 31, a switch 33, a time delay 33, a grounded plate 23, a cathode 27 and an anode 34. This second stage operates substantially identically to the first stage and injects a second relatavistic electron beam into the centerline of the accelerator, so that a second stage space charge well 36 is created downstream of anode 34, significantly further accelerating the ion bunch from the first stage.

In the embodiment shown, the distance between the first and second stages is in the range between 30–50 centimeters, although it should be understood that in other particular embodiments, the distance between stages may vary significantly, from 10 centimeters to as much as a meter. The grounded plate 23 is typically positioned approximately 1–10 inches in front of cathode 27. In operation, the trigger signal which closes switch 20, converting REB power supply 19 to cathode 13 also closes switch 33, which connects REB power supply 31 to cathode 27, although the trigger signal is delayed a specified amount of time by a time delay 35.

The timing of the triggering of the REB power supplies is very important to the proper operation of the invention. In the embodiment shown, the delay of element 35 is in the range of 10–30 nanoseconds, depending on the spacing of the stages. As explained above, an ion bunch from the original ion plasma is accelerated downstream of anode 15 by the space charge well 22 established by the relatavistic electron beam from the first REB stage. The ion bunch is then accelerated by grounded plate 23 into the second stage of the accelerator, and flows through the openings in cathode 27 and anode 34 of the second REB stage. The high current pulses from the second REB power supply 31 are timed so that the space charge well 36 of the second stage is formed just as the ion bunch reaches the region of the space charge well of the second stage. The ion bunch is further accelerated by this second stage charge well and continues flowing downstream at a significantly higher energy level. For the embodiment shown, the increase in ion kinetic energy will be roughly 1–2½ times the kinetic energy of the relatavistic electron beam of the second stage.

FIG. 2 shows a third REB stage, comprising REB power supply 41, switch 42, time delay 44, grounded plate 43, cathode 45 and anode 47. The third stage is identical to the second stage in structure and configuration, and has the same spacing arrangement, relative to the second stage, as the second stage does to the first stage. Time delay 44 delays the output trigger pulse for a sufficient amount of time that the pulses from REB power supply 41 occur at the right instant to create the charge well downstream of anode 47 at the time that the ion bunch comprising the ion beam reaches that region.

Hence, the present invention is a collective field particle accelerator which is capable of producing a charged particle output beam at very high energy levels, significantly above the energy levels of conventional collective field accelerators. This capability is obtained by the use of successive REB stages, arranged in a particular spacial relationship and fired in accordance with a timing sequence which corresponds to the flow rate of the ion bunch through the accelerator. The number of stages used depends upon the energy level desired. The increase in particle energy is cumulative between stages and hence, later stages have the same increasing effect on the energy level as do earlier stages. Thus, very high particle energy levels may be obtained by adding sufficient additional correctly times REB stages to reach the level desired.

Although a preferred embodiment of the invention has been disclosed herein for purposes of illustration, it should be understood that various changes, modifications and substitutions may be incorporated in such embodiment without departing from the spirit of the invention, as defined by the claims which follow.

What is claimed is:

1. A multi-stage collective field charged particle accelerator, comprising:

means forming a charged particle accelerator chamber;

a source of particles which in operation generates a particle plasma for said accelerator chamber;

first electron beam means, including a cathode source of electrons, power supply means for energizing said cathode, and an anode, having an opening therethrough, to which the electrons emitted from said cathode are discharged, the electron beam produced by said first electron beam means being characterized by a high current which exceeds the space charge limiting current, so that the electron beam stops downstream of the anode, thereby creating a space charge region which greatly accelerates a portion of the particles in the particle plasma, said portion forming a high energy particle bunch;

at least one successive electron beam means, positioned downstream of said first electron beam means, for further accelerating the particle bunch by creating another space charge region after it leaves said first electron beam means.

2. An apparatus of claim 1, including timing means for delaying the firing of each successive electron beam means until the particle bunch reaches the vicinity of the space charge regiion of each successive electron beam means.

3. An apparatus of claim 2, wherein the kinetic energy of the particle bunch is increased by each successive electron beam means by an amount at least as great as the kinetic energy level of the electron beam of each electron beam means.

4. An apparatus of claim 1, wherein the particles are ions.

5. An apparatus of claim 2, wherein each of the electron beam means includes power supply means for generating a high current, short duration pulse, switch means connecting said power supply means and said cathode source of electrons, and signal means for triggering said switch means, so that the high current, short duration pulae is supplied to said cathode source, and wherein said delaying means includes means for delaying the trigger signal between each successive electron beam means for a specified amount of time.

6. An apparatus of claim 2, wherein the opening in the anode of each electron beam means is approximately 1 centimeter in diameter.

7. An apparatus of claim 4, wherein a portion of the anode in the vicinity of the opening comprises a plastic material which, when bombarded with electrons, produces a plasma of hydrogen protons.

8. An apparatus of claim 2, wherein each of the successive electron beam means includes a plate, having an opening therethrough in registry generally with the opening in the anode of the previous electron beam means and the path of the particle bunch, said plate being positioned slightly upstream of each successive electron beam means and being grounded so as to electrostatically separate any electrons from the electron beam produced by the previous electron beam means from the moving particle bunch.

9. An apparatus of claim 2, wherein each electron beam means is separated from adjacent electron beam means by a distance of approximately 10 to 50 centimeters.

10. An apparatus of claim 8, wherein the path of the particle bunch is generally along the centerline of the accelerator, and wherein the cathode source of each successive electron beam means is positioned off the centerline axis of the accelerator.

* * * * *